US005209406A

United States Patent [19]

Johnson

[11] Patent Number: 5,209,406

[45] Date of Patent: May 11, 1993

[54] SWIVEL VALVE FOR FLUID JET CUTTING

[75] Inventor: Jack L. Johnson, Joplin, Mo.

[73] Assignee: Ingersoll-Rand Company, Woodcliff Lake, N.J.

[21] Appl. No.: 512,218

[22] Filed: Apr. 20, 1990

[51] Int. Cl.[5] ..... B05B 15/06

[52] U.S. Cl. ..... 239/434; 239/587.6; 239/584

[58] Field of Search ..... 239/587, 584, 9, 596, 239/434; 285/276, 281; 901/43, 28, 29

[56] References Cited

U.S. PATENT DOCUMENTS 4,125,035 11/1978 Dooley ..... 901/16 X
4,162,763 7/1979 Higgins ..... 239/101
4,246,838 1/1981 Pulver et al. ..... 99/516
4,561,592 12/1985 Fender et al. ..... 239/587
4,592,495 6/1986 Toda et al. ..... 901/43 X
4,809,885 3/1989 Hayashi et al. ..... 901/43 X

*Primary Examiner*—Andres Kashnikow
*Assistant Examiner*—Kevin P. Weldon
*Attorney, Agent, or Firm*—James R. Bell; Glenn B. Foster; Walter C. Vliet

[57] ABSTRACT

A fluid activated valving apparatus for controlling a very high pressure liquid being adapted for serving as a focused jet liquid stream for use in cutting materials comprising an axially-aligned spindle located sealingly in a liquid delivery conduit adapted to introduce the high pressure liquid into a chamber. One or more bearings are disposed slidably about the free end of a spindle enclosed within the valve body, adapted for sealing engagement, and also to permit unstressed rotation of the spindle through a 360° arc about the spindle longitudinal axis in response to torsional stresses being intermittently exerted on the exposed free end of the spindle.

6 Claims, 7 Drawing Sheets

SWIVEL VALVE FOR FLUID JET CUTTING

BACKGROUND OF THE INVENTION

This invention relates generally to fluid jet cutting nozzles optionally coupled to abrasive additives for incorporation into the cutting stream and more particularly to a swivel valve for use in connection therewith.

In the past, fluid jet cutting nozzles have been coupled with swiveling devices which will allow various degrees of rotation. Limitations associated with prior art devices include the fact that such swiveling devices tend to add more components, take up more space and add extra weight to a cutting nozzle assembly. When these limitations are taken into consideration, they will often limit the applications in which the cutting nozzle assembly can be used.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention, this is accomplished by providing a swivel valve for fluid jet cutting comprising a fluid flow switch, a piston reciprocally moveable in response to the switch and to a valve body, an axially-moveable valve stem pinned to the piston at one longitudinal end and acting in concert therewith. A first conduit is provided for receiving a stream of a high-pressure liquid. An expansion chamber is disposed in a liquid transfer relationship with the conduit located within the valve body. An apertured valve seat is located at one end of the expansion chamber. The valve stem is functionally oriented in the expansion chamber and has its other longitudinal end tip surface adapted to effect an interruptible sealing engagement with the valve seat. A seal is disposed between the valve stem shaft and the chamber, to preclude commingling of fluid and high pressure liquid. A second conduit for liquid outflow is connected to the expansion chamber and provides the valve seat for engaging the free tip of the valve stem when the piston is actuated in the sealing direction. An expansion section is in the second conduit means for developing a laminar flow of the high pressure liquid. A nozzle is on the distal end of the second conduit for shaping the flow pattern of the liquid cutting jet stream upon release from the assembly. A spindle is associated with the first conduit adaptably mounted within the valve body to be rotatable through a 360° arc, whereby unstressed permitted movements of the spindle are possible.

The foregoing and other aspects will become apparent from the following detailed description of the invention when considered in conjunction with the accompanying drawing figures.

BRIEF DESCRIPTION OF THE DRAWING FIGURES

Figure 2:
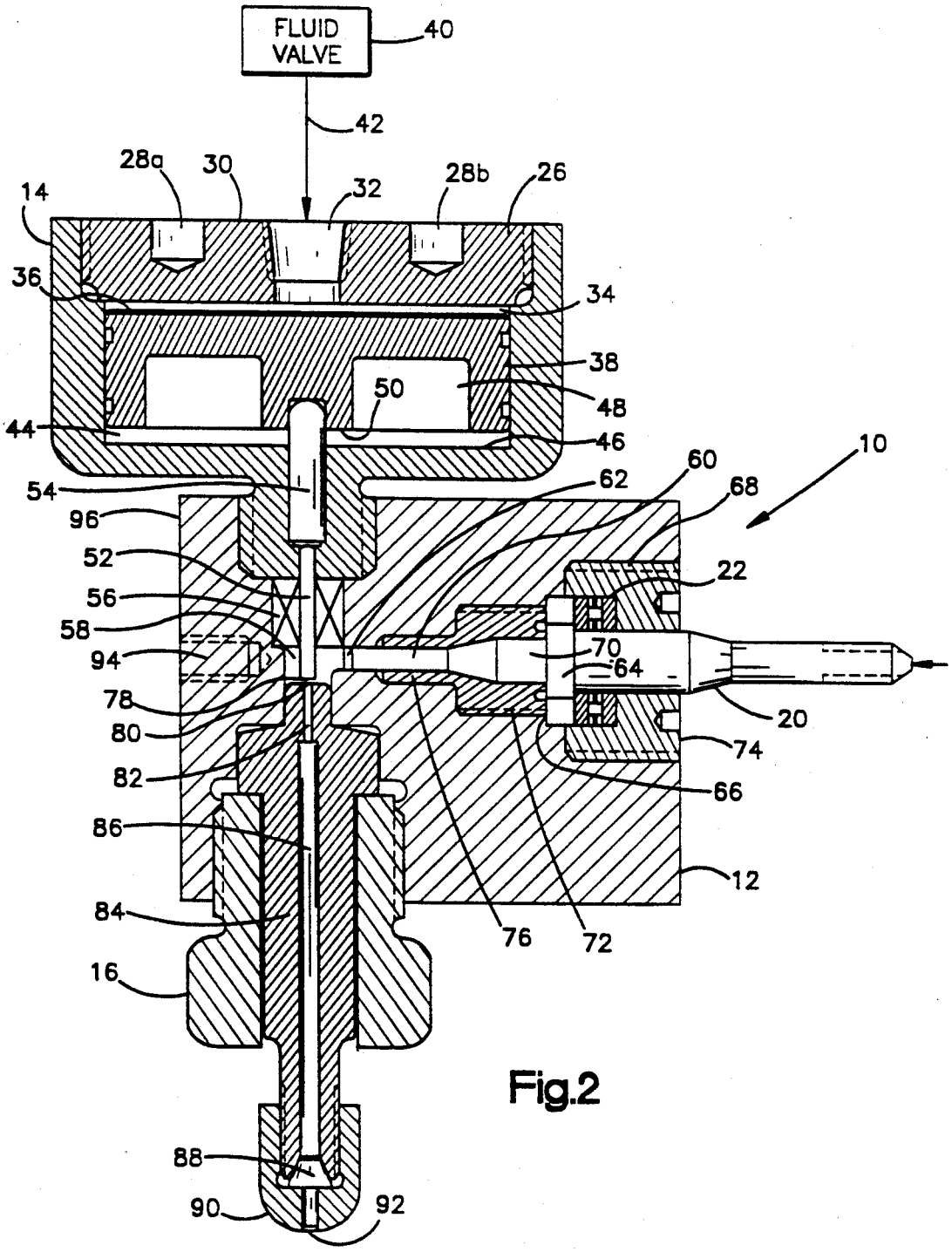
FIG. 2 is a vertical sectional view illustrating an embodiment of the jet cutting assembly of the present invention depicting the valve actuation, the valving, and the liquid jet output components, cooperating according to the present invention.
Figure 5:
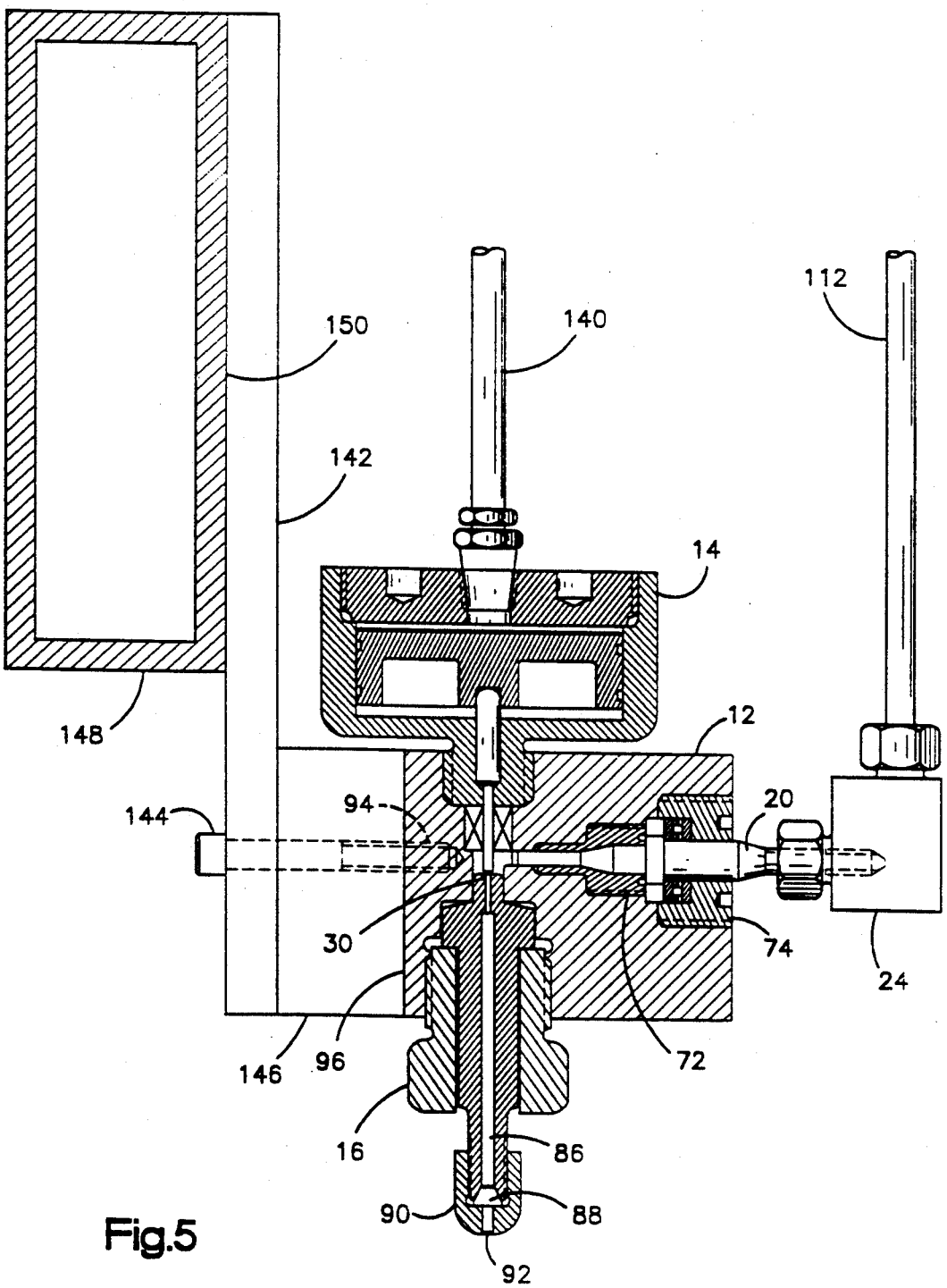
FIG. 5 is a side elevational view, also in section as to the jet assembly of FIG. 2, illustrating a second embodiment of the supporting structure and the high pressure liquid feed to that valving body.
Figure 6:
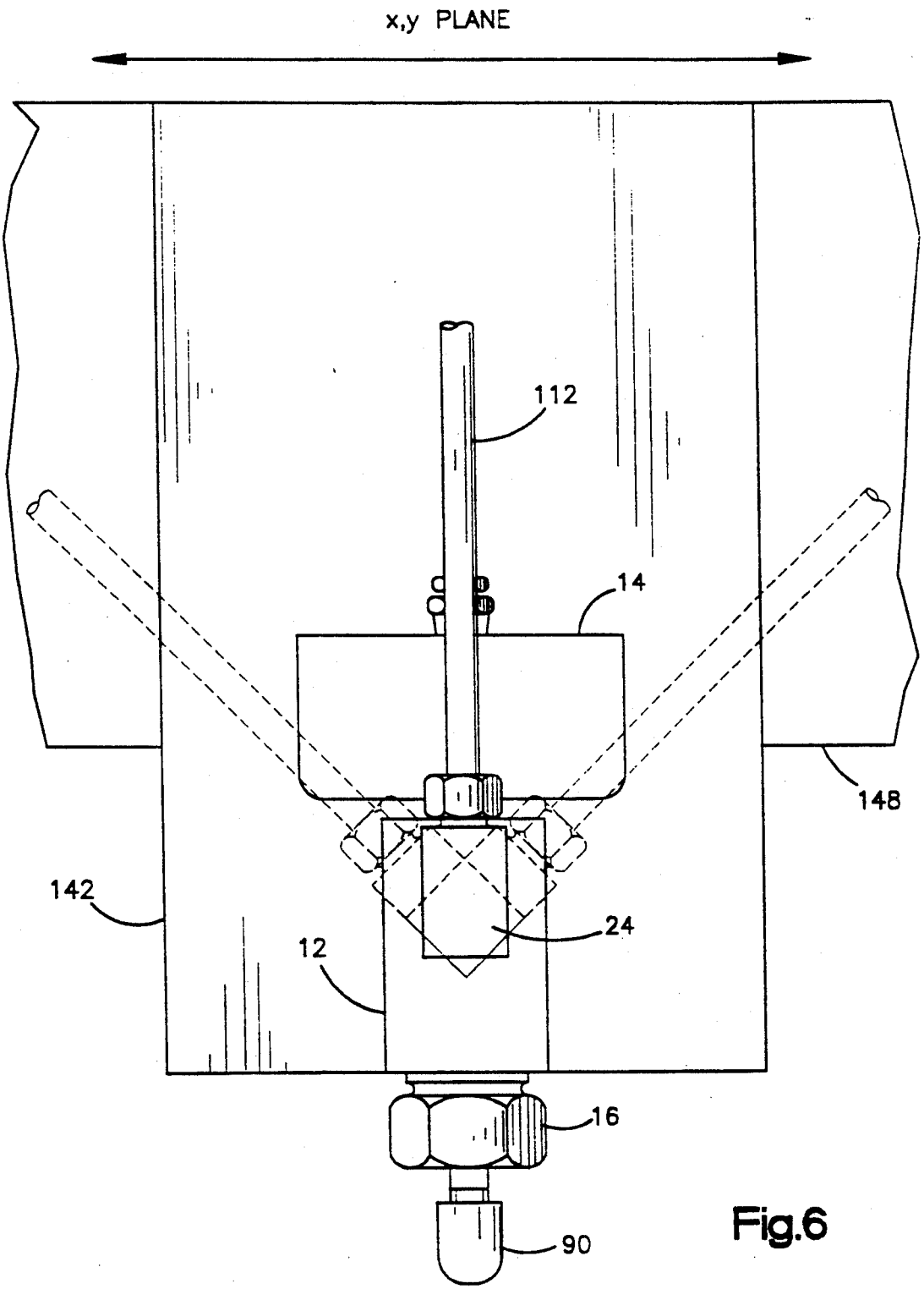
Figure 7:
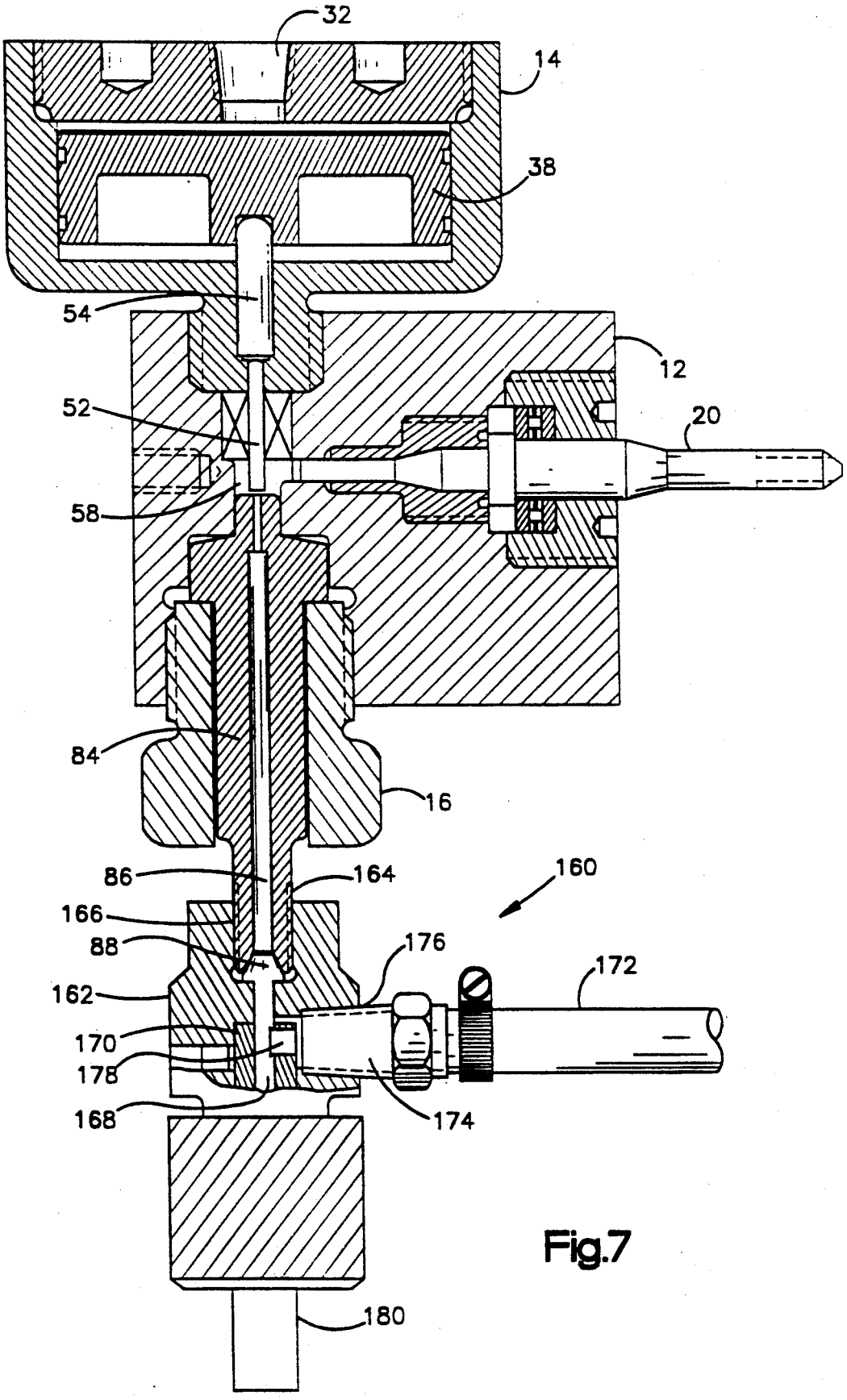

FIG. 6 is a front elevational view of the apparatus of FIG. 5 (fully schematic), illustrating the rotational mobility of the water feed conduit and its associated spindle injection means, relative to the assembly support and activation means (with the alternate directions of conduit rotation being shown) and FIG. 7 is another vertical sectional view of the liquid cutting jet assembly of FIG. 2, with the outlet nozzle end having been modified to include an accessory assembly, adapted for adding a particulate, abrasive material to the focused liquid stream before the cutting jet is beamed upon a workpiece.

DETAILED DESCRIPTION

Figure 1:
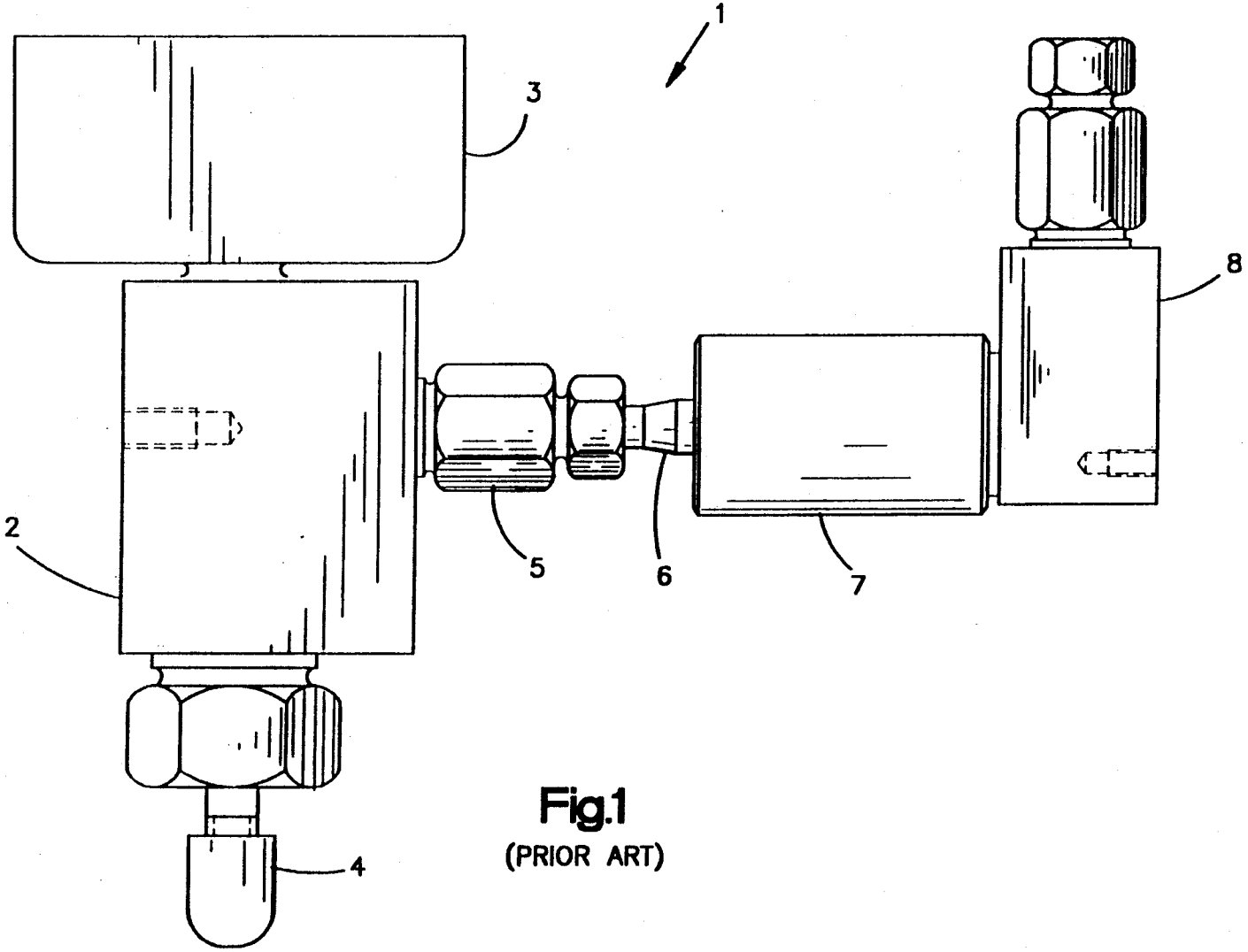
Fig.1 (PRIOR ART)
FIG. 1 is a schematic view of a prior art water valve and cutting assembly as it is coupled to fluid jet cutting nozzle.

Referring now to the drawings in detail, wherein like numerals represent like elements, there is shown in FIG. 1, a typical water jet valve assembly 1 (prior art) in schematic form. The valve 10 comprises a central valve body. component 2, which is operatively connected to an upper valve actuator means 3. The upper valve actuator means 3 is typically a reciprocating piston actuator. Also cooperating with the valving component is a depending fluid output component 4, from which very high pressure, focused fluid jets emerge to impinge upon a checkable material or workpiece (not shown). Connected via a tube adaptor nut means 5 to valve body 2 is a spindle means 6 for admitting high pressure liquid to the valve body interior where the fluid is flow regulated b certain valving components. Such spindle means is encased in a swivelling body 7 that also connects to a liquid supply line 8 which can be rotated relative thereto.

A preferred embodiment of the water jet cutting assembly 10 of the present invention is shown in FIG. 2. The water jet cutting assembly 10 comprises a central valve body 12, which is operatively connected to an upper valve actuator means 14. The upper valve actuator means 14 comprises a reciprocating piston actuator which will be described in more detail hereinafter. Also cooperating with the valving component is a depending fluid output component 16, from which very high pressure, focused fluid jets emerge to impinge upon a checkable material or workpiece (not shown). Inserted into the valve body 12 is a spindle means 20 for admitting high-pressure liquid to the valve body interior where the fluid is flow regulated by certain valving components to be described below.

The valve actuator 14 is composed of a peripherally threaded, planar plate 26 completing the body enclosure of the actuator. Two, offset counterbores, **28*a* and 28*b*, are provided in the upper surface 30 of plate 26**, for mounting purposes. Centrally located is a tapered bore hole 32, (also threaded), which communicates with a variable-volume, cylindrical inner chamber 34, carrying hydraulic fluid that exerts fluid pressure on upper planar surface 36 of piston 38. Central bore 32 in plate 36 is also in fluid communication with an external hydraulic valve 40, by means of hydraulic feed line 42, (shown schematically) the function of which is well-known in the art. The hydraulic valve 40 may be a Skinner solenoid-actuated spool type valve.

Activation of the entire fluid jet assembly 10 is controlled via valve 40 in selectively admitting hydraulic fluid to chamber 34 via feed line 42 and central bore 32. This permits piston 38 to move axially within the confines of head chamber 44, seating itself against planar surface 46 at its point of maximal advance. A deep annular recess 48 is provided in the surface 50 of the piston 36 opposing the planar surface 50 of the piston 36 opposing the planar surface 46 in order to reduce its mass.

Aligned along the central axis of the piston 38 and extending toward the valve body is a valve stem 54 having a reduced diameter length 52 extending into the valve body. The valve stem 54 is fixedly mounted within a bore located on the opposing face 50 of piston 38. The entire valve actuator body 14 is then threadedly fitted (or similarly mounted) into the valve body 12. Disposed about the reduced diameter length 52 of valve stem 54 is a packing combination 56, typically composed of paired adjacent deformable gaskets and an abutting seal, the outer surface of which forms one side of expansion chamber 58 (see, for instance, FIG. 2 of U.S. Pat. No. 4,162,763). The function of the packing 56 is to preclude high-pressure fluid from permeating (along the moving valve stem) into the hydraulic section head space 44 of the actuation valve 14.

Positioned normal to the axis of the valve stem 54 is a liquid inlet passage 60, which is integral of spindle 20. The inlet spindle 20 is detachably inserted into valving body 12, such that its proximal end 62 is located just short of the shaft of reciprocating valve stem 52. Spindle 20 has a flanged midsection 64, which seats on the central shoulder 66 of valve body recess 68.

Interposed about the forward midsection 7 of spindle 20 (ahead of flange 64) is a first packing bearing 72. This provides a resilient backing for the O-ring sealing structure 22, that is disposed circumferentially of the spindle shaft on the opposing face (upstream) of flange 64. A press-fit, cap-like bushing 74, also having an axial bore, compressively biases the O-ring seal 22 against the spindle flange 64. Despite the opposing juxtaposition of bearing 72 and seal 22, they do permit rotation of spindle 20, and will tolerate minor misalignments from the intended perpendicular incidence of the spindle 20 and the axis of valve stem 54. Ahead of seal 72 is an abutting, sleeve-like seal 76 that embraces the innermost spindle segment 60.

The beveled tip 78 of reduced diameter length 52 of valve stem 54 seals by contacting with fluid exit port 80 of expansion chamber 58.

Accordingly, as the valve stem 54 is actuated to retract at least partly from port 80, high pressure water flows through expansion chamber 58, fluid exit port 80, aperture-bearing extension 82, and into expansion conduit 86 of outflow spindle 84, causing instant outflow through a nozzle element 88. In this manner the high pressure fluid performs its cutting function on various articles that are to be located below the effluent jet, such as alloyed steel, Kevlar materials and even fiberglass-reinforced objects Remembering that the larger diameter shaft segment of the valve stem 54 is pinned fixedly within the lower surface recess 50 of piston 38 such that as stem 54 is moved outward, the resulting flow through expansion chamber 58 and outflow passage 86 causes an increase in the hydraulic pressure, now ranging up to 60,000 psi, which is delivered through the nozzle 88. The outflow passage 86 also reduces turbulence in the fluid as such fluid expands and flows through the passage.

Threadedly connected to the lower end of the outflow spindle 84 psi a cap assembly 90. The effluent jet liquid emerges from outlet port 92 to produce a finely-shaped and focused, high-velocity liquid jet caused by the stated pressure magnitude.

When the jet cutting action is to cease, the fluid is actuated in the forward mode to force fluid through line 42 into chamber 34 forcing piston 38 and its pinned stem 54 toward the valve body 12 until the latter seats stem 54 hermetically within the valve seat formed by the proximal end of the outflow spindle 84. Sealing is accomplished by the stem tip 78 coming into contact against the walls of the fluid exit port 80. The high-pressure water flow is shut-off from expansion conduit 86, until the stem is again moved outward to permit flow through the expansion chamber 58.

A tapped bore 94 is shown as located in the sidewall 96 of valve body 12. The side wall 96 of valve body 12. The side wall 96 opposes the wall receiving the spindle 20. The bore 94 is one of a group of two or more, horizontally-aligned, bores which serve to mount the water jet cutting assembly 10 via the valve body 12 onto bolts, for example, of a robot arm. The securing of valve body 12 to such a robot arm anchors the spindle 20 in a fixed longitudinal position, but is one which permits it to be rotatable through a 360° ARC. A first mode of the high pressure liquid inflow to the spindle permits such rotation, as is depicted in FIGS. 3 and 4.

Figure 3:
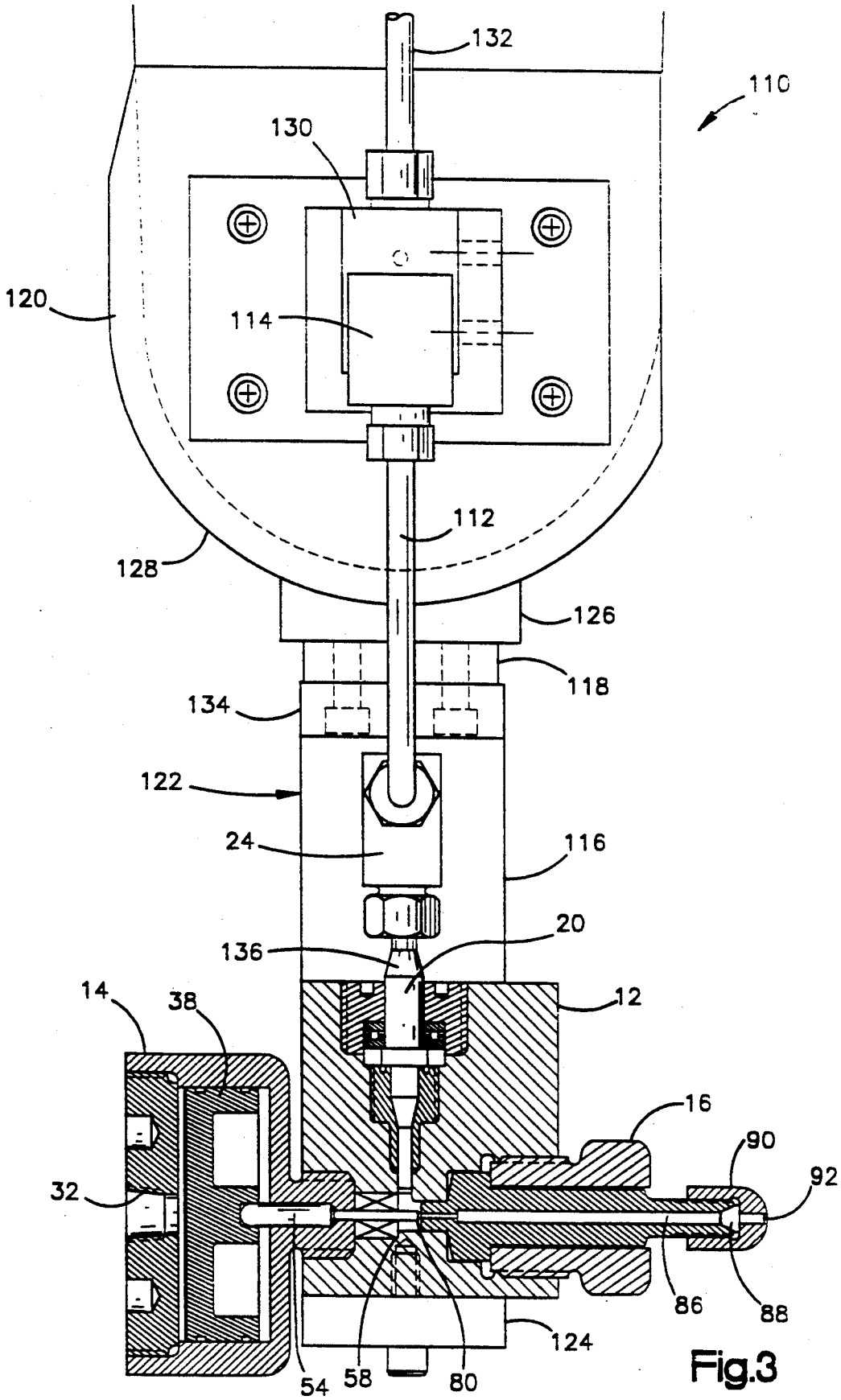
FIG. 3 is an end elevational view, partly in section as to the complete jet assembly of FIG. 2, illustrating the first embodiment of a supporting structure for both the valve body and for the upstream flow components, which provide high pressure liquid to the spindle-type feed element of the present invention.

A first embodiment for a jet stream device assembly supporting structure and robotic-controlled manipulation of the assembly of FIG. 2 (now turned 90) is depicted in the elevational view of FIG. 3. The water jet assembly 10 depends from, and is pinned to, a support structure, generally 110. Liquid injection spindle 20 is operably connected to a fluid coupler 24, which, in turn, is fed from a reinforced flexible conduit 112 that terminates in a second fluid coupler 114 connected to an overhead high-pressure liquid main supply (not shown).

Figure 4:
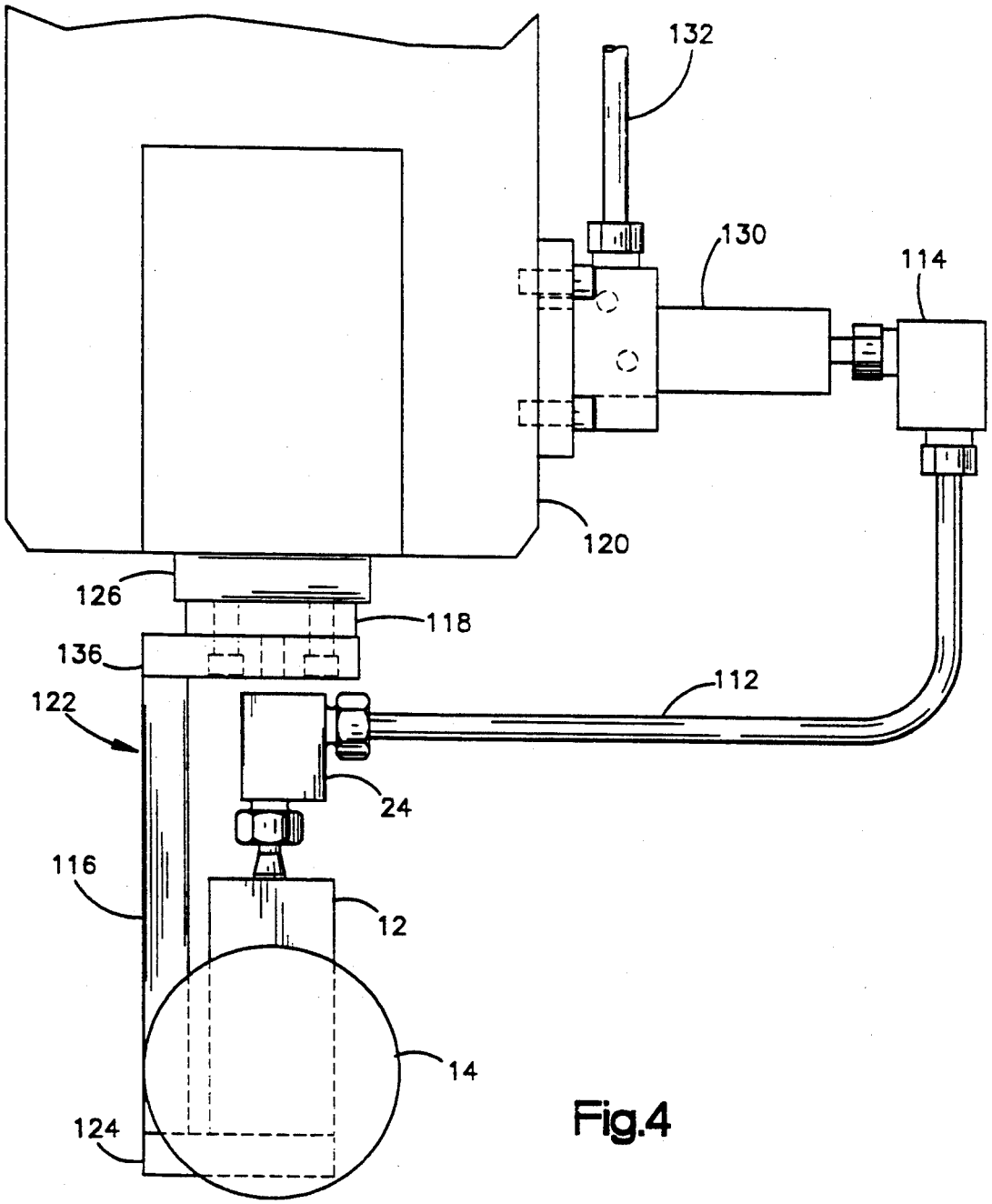
FIG. 4 is a side elevational view, being fully schematic as to the jet assembly of FIG. 2, illustrating the supporting structure and high pressure liquid feed means to the valving component of FIG. 3.

Depending plate member 116 is supported by (and bolted to) a space element 118 mounted on the undersurface of the overlying robot arm 120, as will be better seen in the corresponding side elevational view of FIG. 4. In this companion view, the water jet assembly is viewed from the valve actuator body end and plate member 116 is an integral member of U-shaped support bracket 122. Upon the distal platform 124 of bracket 122, the valve body 12 is securely fastened. An arc-shaped fitting 126 is fixedly mounted on the curvilinear end 128 of robot arm 120, and supports depending U-shaped bracket 122.

The upsteam liquid coupler 114 is operatively connected to liquid supply header 130 which, in turn, is supplied by main liquid feed conduit 132. As for downstream coupler 24 (connected direct to spindle means 20), it is spaced-apart slightly from the U-bracket proximal arm 134. This provides a somewhat flexible, elongate end of liquid feed conduit 112. This mounting configuration, while holding inflow spindle 20 in a set position relative to the water jet cutting assembly, permits the control valve body 12 thereof to be rotatable in a 360° arc, about the axis of spindle 20.

Mounting of all elements is accomplished by using bolts threaded into cooperating threaded apertures. Flow is maintained and leakage prevented through the use of known coupling devices having appropriate cooperating threaded junction and sealing members.

A second embodiment for a water jet cutting assembly support structure and robotic manipulation means of the present invention shown in FIG. 2, is depicted in the side elevation view of FIG. 5. The full sectioned flow device, the water jet cutting assembly 10, shown therein identical to that described in connection with FIG. 2. Flow actuating device or valve actuator 14 is provided with a fluid supply via vertically-disposed conduit 140. Valve body sidewall 96 has its tapped bore 94 securely mounted to vertically positioned rigid plate 142 by means of a long, threaded bolt 144, passing through spacer 146. Plate 142, in turn, depends from, and is fixedly secured to hollow support beam 148, along its one side wall 150.

On the opposite sidewall of valve body 12 there is located the horizontally-aligned, flexibly-mounted, liquid supply spindle 20. Spindle 20 is constructed and mounted mostly within the valve body 12, as was previously described. Fluid feed coupling element 24 is secured conventionally to the protruding nipple end of the spindle 20. Coupling 24 is linked at its other operative face to high pressure liquid feed conduit 112.

As the plate or support arm 142 and beam 148 are moved together, in either an X or Y direction from their rest or neutral position depicted in FIG. 6, the juxtaposition of feed conduit 112, compared to the support plate 142 and fixedly positioned valve body 12, will describe an arc-like path, as is depicted in the phantom views of FIG. 6.

The reciprocal lateral movement (in the X,Y Plane 4) of support plate 142 (as indicated by the double-headed linear arrow) creates a distortional movement away from the at rest point for spindle 20. The orientation of spindle 20 remains substantially perpendicular to the internal valve stem 54 (FIG. 2) permit this axial rotational movement of the spindle 20 and minor perpendicular misalignment to be effected without such torsional stress on spindle 20 as could induce structural cracking.

In operation of the first embodiment for the supporting structure of FIGS. 3 and 4, as piston head 38 of actuator 14 retracts from its seating against surface 46, the pinned valve stem 54/52 lifts away from valve seat 80, permitting the liquid to flow through the expansion chamber 58 and outflow passage 86 to orifice 92, emerging as a focused, very high velocity liquid jet of substantial cutting power. Liquid will continue to flow from header 130, through coupler 114, conduit 112, and coupler 24 into spindle 20 so long as valve stem tip 78 is spaced apart from the valve seat 80.

Rotation of robot-arm pinned support bracket 110 (to which valve body 12 is anchored), causes like rotation of the entire water jet cutting assembly 10. As the liquid feed conduit 112 is similarly anchored at its distal end to header 132 (mounted on robot arm 120), the torsional stresses imposed on the external portion 136 of spindle 20 are dampened by the bearings surrounding the spindle within the valve body.

In operation of the second embodiment for the supporting structure of FIGS. 5 and 6 again while valve stem 54/52 is displaced from the valve seat 80, the focused liquid jet emerges from nozzle 88. Liquid flows through conduit 112 into coupler 24 and enters spindle 20, flowing to expansion chamber 58 and through outlet conduit 86. Movement of support plate 142, in either translational direction (horizontally or vertically), will now be tolerated by the spindle, without compromising its structural integrity, due to the introductions of the thrust bearings 72, 74 surrounding spindle 20 within valve body 12.

A third embodiment of the water jet cutting assembly 10 is seen in FIG. 7, wherein the cap assembly 90 of fluid output element 16 in FIG. 2 has been removed and is replaced with an auxiliary fluid inflow assembly 160. The structural modification serves to permit the introduction or entraining of a particulate abrasive into the water cutting jet of outlet conduit 86 and nozzle 88. Such abrasive is added to the jet flow stream proximal to the liquid exit point from the nozzle 88. Typically, the added material is a finely crystallized garnet, but other hardened crystals, such as diamond bits, could be usefully employed.

Assembly 160 comprises an elongated, solid member 162, the longitudinal axis of which is coincident with the central axis of outlet conduit 86 of outflow component 16. Member 162 has a proximal end threaded counterbore 164, adapted to receive the depending threaded nipple end 166 of output element 16. The orifice 92 of the nozzle 88 ends just above the point where the stream of abrasive material enters a second expansion chamber 168 at right angles thereto Chamber 168 is provided with an annular collar 170 to protect its sidewalls from eroding, caused by the entering high velocity, abrasive stream.

The particulate abrasive, conveniently entrained in high pressure water, enters the system through tubing 172, to make a right angle injection into the liquid jet in chamber 168 which emerges from outlet conduit 86. The tubing 172 is attached to a threaded nipple 174 configured much like upstream spindle 20, which engages a recess 176 in member 162 for aligning the abrasive outlet port 178 of the nipple 174 within the chamber 168. The admixed abrasive and water jet flow exit from the assembly via nozzle 180 and are directed at the workpiece.

Having described the invention, what is claimed is:

1. A swivel valve for fluid jet cutting comprising:

a fluid flow switch;

a piston reciprocally movable in response to the switch and mounted to a valve body;

an axially-moveable valve stem means pinned to said piston at one longitudinal end for acting in concert therewith;

first conduit means for receiving a stream of a high-pressure liquid;

an expansion chamber disposed in a liquid transfer relationship with said conduit means located within said valve body;

an apertured valve seat located at one end of the expansion chamber;

the valve stem being functionally oriented in said expansion chamber and having on its other longitudinal end a tip surface adapted to effect an interruptible sealing engagement with the valve seat;

seal means disposed between a shaft portion of the valve stem and said chamber to preclude commingling of fluid and high pressure liquid;

second conduit means for liquid outflow connected to said expansion chamber and providing the valve seat for engaging a free end tip of said valve stem when said piston is actuated in said sealing direction;

an expansion section in said second conduit means for developing a laminar flow of said high pressure liquid;

nozzle means on a distal end of said second conduit means for shaping the flow pattern of the liquid cutting jet stream upon release from the assembly, wherein the nozzle means is modified to receive a fluid injection means for introduction of a particulate abrasive material into the liquid cutting jet stream before emerging from said assembly; and spindle means associated with the first conduit means adaptable mounted within the valve body to be rotatable through a 360° degree arc, whereby unstressed permitted movements of the spindle means are possible.

2. The valve of claim 1 wherein the valve containing the expansion chamber and the first and second conduits is secured upon and made movable by a robot arm, adapted to traverse in both linear and curvilinear directions, said first conduit means including an axially-aligned spindle located sealing therein, and with the free end of the spindle means being adapted to permit its unstressed rotation in response to torsional stresses being intermittently exerted upon it by a linked external liquid feed conduit means.

3. The valve of claim 1 wherein the valve body and first and second conduits are secured directly to a robot arm, being moveable therewith in the X and Y dimensions of the plane of said arm, and said body concurrently having an axially aligned spindle means located sealingly in the first conduit, which spindle is externally and operationally connected to a feed liquid supply conduit means and is adapted to undergo unstressed rotation in response to torsional forces being exerted upon the axis of said spindle by said feed liquid supply conduit.

4. In a fluid activated valving apparatus for controlling a very high pressure liquid being adapted for serving as a focused liquid cutting jet stream assembly including hydraulic switching means, a piston responsive to the switching means, a valving stem pinned to the piston, an expansion chamber associated with the stem, a liquid conduit delivery means for receiving a high pressure liquid stream and directing same to the chamber, a valved liquid outlet means disposed spaced apart in the expansion chamber cooperating with the stem to valve high pressure liquid outflow from the chamber, a nozzle means at a distal end of the liquid outflow means for forming a focused liquid jet stream for use as a cutting means, all located within or connected to a valve body, the improvement comprising:

an axially-aligned spindle means located sealingly in the liquid conduit delivery means of the valve body for introducing the high pressure liquid into the chamber, and a bearing means disposed slidably about the free end of the spindle means enclosed within the valve body for making sealing engagement therewith, but also permitting unstressed rotation of the spindle means in response to torsional stresses being intermittently exerted on said exposed free end of the spindle means, wherein the nozzle means is modified to receive a fluid injection means for introduction of a particulate abrasive material into the cutting stream before emerging from said assembly.

5. The valve of claim 4 wherein the valve body is secured upon and made movable by a robot arm, adapted to traverse in both linearly and curvilinear directions, said liquid conduit delivery means including an axially-aligned spindle located sealingly therein, and with the free end of the spindle means being adapted to permit its unstressed rotation in response to torsional stresses being intermittently exerted upon it by a linked external liquid free conduit means.

6. The valve of claim 4 wherein the valve body is secured directly to a robot arm, being movable therewith in either of the X and Y dimensions of the plane of said arm, and said body concurrently having an axially aligned spindle means located sealingly in the liquid conduit delivery means of the valve body, which spindle is externally and operationally connected to a feed liquid supply conduit means and is adapted to undergo unstressed rotation in response to torsional forces being exerted upon the axis of said spindle by said feed liquid supply conduit.

* * * * *